US010246970B2

(12) United States Patent
Deacon et al.

(10) Patent No.: US 10,246,970 B2
(45) Date of Patent: Apr. 2, 2019

(54) LANDING STRING

(71) Applicant: Expro North Sea Limited, Dyce, Aberdeenshire (GB)

(72) Inventors: Paul Deacon, Aberdeen (GB); Jamie Walker, Aberdeen (GB); Dariusz Szpunar, Aberdeen (GB)

(73) Assignee: Expro North Sea Limited, Aberdeen (GB)

( * ) Notice: Subject to any disclaimer, the term of this patent is extended or adjusted under 35 U.S.C. 154(b) by 0 days.

(21) Appl. No.: 15/325,632

(22) PCT Filed: Jun. 9, 2015

(86) PCT No.: PCT/GB2015/051680
§ 371 (c)(1),
(2) Date: Jan. 11, 2017

(87) PCT Pub. No.: WO2016/005721
PCT Pub. Date: Jan. 14, 2016

(65) Prior Publication Data

US 2017/0152723 A1 Jun. 1, 2017

(30) Foreign Application Priority Data

Jul. 11, 2014 (GB) ..... 1412397.0

(51) Int. Cl.

| | |
|---|---|
| ***E21B 33/06*** | (2006.01) |
| ***E21B 34/04*** | (2006.01) |
| ***E21B 34/02*** | (2006.01) |
| ***E21B 41/00*** | (2006.01) |
| ***E21B 17/01*** | (2006.01) |

(52) U.S. Cl.
CPC ..... *E21B 34/045* (2013.01); *E21B 17/01* (2013.01); *E21B 33/063* (2013.01); *E21B 34/02* (2013.01); *E21B 34/04* (2013.01); *E21B 41/0014* (2013.01)

(58) Field of Classification Search
CPC ..... E21B 34/045; E21B 33/063
See application file for complete search history.

(56) References Cited

U.S. PATENT DOCUMENTS

| | | | | |
|---|---|---|---|---|
| 4,880,060 | A * | 11/1989 | Schwendemann .... | E21B 34/045 166/319 |
| 5,857,523 | A | 1/1999 | Edwards | |
| 6,206,338 | B1 | 3/2001 | Trail et al. | |
| 6,293,344 | B1 * | 9/2001 | Nixon ..... | E21B 34/045 166/321 |

(Continued)

FOREIGN PATENT DOCUMENTS

| | | |
|---|---|---|
| EP | 1336721 A2 | 5/2008 |

*Primary Examiner* — D. Andrews
*Assistant Examiner* — Dany E Akakpo
(74) *Attorney, Agent, or Firm* — O'Shea Getz P.C.

(57) ABSTRACT

A landing string includes a valve having a valve member mounted within a flow path extending through the landing string, and a valve control system for use in operating the valve to move the valve member between open and closed positions to control flow along the flow path. The valve control system is reconfigurable between a first configuration in which the valve is operated or controlled under a fail-as-is (FAI) mode of operation, and a second configuration in which the valve is operated or controlled under a fail-close (FC) mode of operation.

21 Claims, 10 Drawing Sheets

(56) References Cited

U.S. PATENT DOCUMENTS

| | | | | |
|---|---|---|---|---|
| 2001/0035512 | A1* | 11/2001 | Messer | F16K 31/02 251/129.04 |
| 2004/0134665 | A1 | 7/2004 | Greeb et al. | |
| 2006/0060360 | A1 | 3/2006 | Moncus et al. | |
| 2007/0272415 | A1 | 11/2007 | Ratliff et al. | |
| 2008/0029273 | A1 | 2/2008 | Pia | |
| 2008/0110633 | A1 | 5/2008 | Trewhella | |
| 2011/0036588 | A1 | 2/2011 | Heironimus | |
| 2013/0153242 | A1 | 6/2013 | Flight et al. | |
| 2015/0176368 | A1 | 6/2015 | Martin | |

* cited by examiner

LANDING STRING

This application claims priority to PCT Patent Appln. No. PCT/GB2015/051680 filed Jun. 9, 2015, which claims priority to UK Patent Appln. No. 1412397.0 filed Jul. 11, 2014.

FIELD OF THE INVENTION

The present invention relates to a landing string a method of use.

BACKGROUND OF THE INVENTION

Landing strings are used in the oil and gas industry for through-riser deployment of equipment, such as completion architecture, well testing equipment, intervention tooling and the like into a subsea well from a surface vessel. When in a deployed configuration the landing string extends between the surface vessel and the wellhead, for example a wellhead Blow Out Preventer (BOP). While deployed the landing string provides many functions, including permitting the safe deployment of wireline or coiled tubing equipment through the landing string and into the well, providing the necessary primary well control barriers and permitting emergency disconnect while isolating both the well and landing string.

Well control and isolation in the event of an emergency disconnect is provided by a suite of valves which are located at a lower end of the landing string, normally positioned inside the central bore of the BOP. The BOP therefore restricts the maximum size of such valves. The valve suite includes a lower valve assembly called the subsea test tree (SSTT) which provides a safety barrier to contain well pressure, and an upper valve assembly called the retainer valve which isolates the landing string contents and can be used to vent trapped pressure from between the retainer valve and SSTT. Typically, the valves within a landing string provide a shear and seal capability, such that any objects present in the landing string, such as wireline, will be severed, allowing a seal to then be established.

The landing string also typically includes features allowing interaction with a BOP or wellhead architecture. For example, a shear sub component may extend between the retainer valve and SSTT which is capable of being sheared by the BOP if required. Also, one or more slick joints may be provided to allow sealing engagement with BOP pipe rams. Further, a lowermost end of a landing string typically includes a tubing hanger arrangement which mates with a wellhead tubing hanger assembly.

Many landing string designs operate under certain safety protocols, often dictated by industry standards. For example, in some instances valves, such as a retainer valve, may be designed to operate under a fail-close protocol, in which the valves will automatically close in the event of a loss of control, such as a loss in hydraulic power. In some instances this might be overly cautious, in that certain valve control failures may not necessarily present a real risk to loss of well control, for example where other well control barriers are fully intact and operational, where loss in control is temporary and/or intentional and the like. In circumstances where an object, such as wireline is present at the time of failure, a fail-close valve may unnecessarily sever the wireline, dropping any associated tooling or equipment into the wellbore, requiring time-consuming fishing operations to recover.

In other instances valves, such as a retainer valve, may be designed to operate under a fail-as-is protocol, in which the valve remains in position in the event of loss of control. While this might avoid severing an object such as wireline, this does present other issues such as where a genuine emergency situation arises in which a full closure of the valve would be preferred.

Furthermore, landing strings are often used to accommodate flow back from the well to a surface vessel, for example during well testing, clean-up and the like. Accordingly, the entire length of the landing string could potentially contain well fluids under pressure in the event of an emergency disconnect situation. In such circumstances it is the purpose of the retainer valve to contain the fluids within the landing string upon disconnect. Although this is particularly important in all wells, in gas wells the pressurised gas within the landing string will carry significant energy, and in the event of an emergency disconnect this could cause the upper landing string to eject upwardly through the vessel. As such, it is important for the retainer valve to react quickly, to ensure the landing string fluids are contained.

SUMMARY OF THE INVENTION

An aspect of the present invention relates to a landing string, comprising: a valve having a valve member mounted within a flow path extending through the landing string; and a valve control system for use in operating the valve to move the valve member between open and closed positions to control flow along the flow path, wherein the valve control system is reconfigurable between a first configuration in which the valve is operated or controlled under a fail-as-is (FAI) mode of operation, and a second configuration in which the valve is operated or controlled under a fail-close (FC) mode of operation.

An aspect of the present invention relates to a method for operating the landing string of any other aspect. The method may comprise locating at least part of the landing string within a blow out preventer (BOP). The method may comprise operating the BOP to cut the landing string to create a failure event.

An aspect of the present invention relates to a method for controlling a valve within a landing string, such as a landing string according to any other aspect.

An aspect of the present invention relates to a method for controlling a valve within a landing string which includes a flow path, a valve member mounted within the flow path, and a valve control system for use in operating the valve to move the valve member between open and closed positions to control flow along the flow path, the method comprising: configuring the valve control system in a first configuration in which the valve is operated or controlled under a fail-as-is (FAI) mode of operation; and reconfiguring the valve control system into a second configuration in which the valve is operated or controlled under a fail-close (FC) mode of operation.

According, in use, the valve control system may be reconfigurable to permit the same valve to operate under either a FAI mode of operation or a FC mode of operation. This may provide the landing string with significant advantages in that both modes are permissible.

The FAI mode of operation may be considered as one in which the valve member will remain substantially in a current position upon occurrence of a failure event. In some cases this may be established by the absence of any power applied to the valve, for example by the valve control system, following the failure event. For example, if the valve is in its open position, the valve will not be positively moved towards its closed position following a failure event. However, in some circumstances, despite no positive power applied, the valve member may nevertheless be caused to move following a failure event, for example by flow, pressure and/or other conditions within the landing string unrelated to the valve control system.

The FC mode of operation may be one in which the valve member will be positively caused to move from a current position, typically an open position, to a closed position upon occurrence of a failure event. In some cases this may be established by permitting exposure to or applying a positive power to the valve following a failure event.

The failure event may comprise a failure associated with the valve control system. The failure event may comprise a loss in power associated with the valve. For example, the failure event may comprise a loss in a valve opening power supply, a valve closing power supply or the like.

The failure event may comprise a disruption in one or more power conduits or lines associated with the valve control system. Such disruption may be caused by damage, such as severing, of one or more power conduits.

The failure event may comprise shearing of a portion of the landing string by external equipment, such as a BOP within which at least a portion of the landing string is located. The failure event may comprise shearing of a power conduit which extends along the landing string by external equipment, such as a BOP.

The valve control system may be reconfigurable in accordance with an operator preference. For example, an operator may actively reconfigure the control system between the FAI and FC modes of operation. The selection of the mode of operation may be in accordance with a specific landing string operation.

In one example, an operator may reconfigure the valve control system to the FC mode of operation when a failure event causes significant risk of well control. For example, an operator may configure the valve control system to the FC mode of operation during flow operations from a well via the landing string.

In another example an operator may configure the valve control system to the FAI mode of operation when a failure event may provide minimal risk of a loss in well control. For example, an operator may configure the valve control system in the FAI mode of operation during deployment of the landing string.

The valve control system may be reconfigurable between the FAI and FC modes of operation in accordance with an external event, for example in accordance with operation of a BOP. In one example, activation of a BOP shear ram may reconfigure the valve control system into its FC mode of operation.

The valve may comprise or define a retainer valve of the landing string. The retainer valve may be operable to selectively contain fluids within the landing string above the retainer valve. This may permit the landing string to be parted at a location below the retainer valve, for example using a latch within the landing string. Such parting may be achieve without escape of the fluids above the retainer valve. This may be particularly advantageous where the landing string contains pressurised gas.

The valve may be operable to sealingly close the flow path through the landing string.

The valve may be operable to cut an object, such as wireline, coiled tubing, tooling or the like located within the flow path of the landing string during movement of the valve member from its open position to its closed position.

The valve may comprise a shear and seal valve.

The valve may comprise a ball valve. In such an arrangement the valve member may comprise a ball valve member.

The valve may comprise a valve actuator for use in operating the valve member to move between open and closed positions.

In one preferred embodiment the valve actuator may comprise a hydraulic actuator configured for operation by application of hydraulic power. In such an embodiment the valve control system may comprise a hydraulic control system. In other embodiments the valve actuator may comprise a pneumatic actuator, mechanical actuator, electro-hydraulic actuator, electro-mechanical actuator or the like.

The valve may comprise an opening port for facilitating communication with a source of power to operate the valve member to move towards an open position. The opening port may comprise a fluid port.

The valve may comprise a closing port for facilitating communication with a source of power to operate the valve member to move towards a closed position. The closing port may comprise a fluid port.

The landing string may comprise an opening line for providing communication between the valve and a source of power to facilitate opening of the valve member. The opening line may provide communication between a source of power and an opening port of the valve.

The opening line may provide fluid communication with a source of power provided on a surface vessel from which the landing string extends. The opening line may provide fluid communication with a source of power provided remotely from the surface vessel.

The opening line may be configured to communicate power to other components or systems, such as other components or systems of the landing string. The opening line may be configured to communicate power to a latch of the landing string. Such a latch may be provided to facilitate parting of the landing string. The latch may be positioned below the valve. In some embodiments the opening line may be configured to communicate a source of power to retain the latch in a locked position.

A failure event associated with the valve control system may comprise damage to, such as severing, of the opening line, which may result in a loss of control of the valve. Such damage to the opening line may prevent said opening line from maintaining charge, such as pressure. The failure event may comprise severing of the opening line by a BOP.

The landing string may comprise a closing line for providing communication between the valve and a source of power to facilitate closing of the valve member. The closing line may provide communication between a source of power and a closing port of the valve.

The closing line may provide communication with a source of power provided on a surface vessel from which the landing string extends. The opening line may provide communication with a source of power provided remotely from the surface vessel.

The landing string may comprise a power accumulator, such as a pressure accumulator, associated with the closing line. Such a power accumulator may store charged power, such as pressurised fluid, for use in applying to the closing line when required. This may permit increased response time to closing of the valve. Further, this may permit additional safety measure within the landing string such that power may be available from the power accumulator in the event of a failure or compromise of a primary power source.

The opening and closing lines may be selectively controlled to provide charging and venting to permit the valve member to be appropriately opened and closed, for example to avoid hydraulic locking of the valve member. For example, to permit opening of the valve member charge may be applied in the opening line, while the closing line may be vented. Conversely, to permit closing of the valve member charge may be applied in the closing line, while the opening line may be vented The landing string may comprise a control valve for use in controlling power supplied to the valve. The control valve may be operable to selectively communicate a closing line with the valve. The control valve may be operable to selectively communicate the closing line with a closing port of the valve.

The control valve may faun part of the valve control system.

The control valve may be operable between first and second configurations.

When the control valve is in the first configuration the closing line may be arranged in communication with the valve, for example in communication with a closing port of the valve. This may be deemed an open configuration of the control valve.

When the control valve is in the first configuration, charge, such as pressure, applied within the closing line may facilitate operation of the valve member to move, and/or be held, within its closed position.

When the control valve is in the first configuration, venting may be permitted from the valve, for example from a closing port of the valve. Such an arrangement may permit power applied via an open line to cause the valve to open, avoiding issues such as hydraulic lock.

When the control valve is in the first configuration operation of the valve to close may be dependent on venting of charge, for example pressure, from the opening line. This may avoid issues such as hydraulic locking preventing the valve form being closed.

Closing of the valve may be dependent on one or more of the control valve being in the first configuration, the presence of sufficient charge within the closing line, and venting of the opening line.

When the control valve is in the second configuration the closing line may be isolated from the valve. This may prevent the valve from being closed. As such, the second configuration may be deemed a closed configuration of the control valve.

In one embodiment, when the control valve is in the second configuration, venting may be permitted from a portion of the valve, for example from a closing port of the valve. Such an arrangement may permit power applied via an open line to cause the valve to open, avoiding issues such as hydraulic lock.

In an alternative embodiment, when the valve is in the second configuration, venting may be prevented from a portion of the valve, for example from a closing port of the valve. In some cases this may assist to lock the valve in an open position.

The control valve may be biased in a preferred direction.

In one embodiment the control valve may be biased towards the first configuration. Accordingly, in the absence of any other control, the control valve may remain in the first or open configuration. This may define the valve as a normally open control valve.

The landing string may comprise a pilot line associated with the control valve. The pilot line may facilitate communication of a pilot charge, such as pilot pressure, to operate the control valve to selectively move between its first and second configurations.

In one embodiment pilot charge within the pilot line may operate the control valve to move from its first position, which may be an open position, to its second position, which may be a closed position.

Relief of pilot charge from the pilot line may permit the control valve to move from its second position to its first position.

In some embodiments the pilot line may provide a dedicated function of operating the control valve. The pilot line may be defined by a pigtail line.

In other embodiments the pilot line may provide additional functions. For example, in some embodiments the pilot line may also define a valve opening line.

In some embodiments a failure event of the valve control system may comprise damage, such as by severing, of the pilot line, for example by a BOP. In such an event any charge within the pilot line may be vented, thus causing the control valve to move towards its first or open position, establishing communication of the closing line with the valve.

The valve control system may be configured in the FC mode of operation by charging the closing line while arranging the control valve in its second or closed position, for example by applying charge, such as pressure, in a pilot line, thus isolating the charged closing line from the valve. On the occurrence of a failure event, the control valve may be moved to its first position to expose the valve to the charged closing line, thus causing the valve to close (more specifically fail close).

In some embodiments the failure event may include damage to, such as severing of the pilot line, causing the control valve to move, for example under action of a biasing force, towards its first or open position, establishing communication of the charged closing line to the valve.

In some embodiments, damage to the pilot line, such as by being severed, may occur simultaneously with damage to the opening line, for example by action of a BOP. As such, the opening line may be vented allowing the valve to close.

The valve control system may be configured in the FAI mode of operation by not charging or preventing the closing line from being charged while the control valve is in its second or closed configuration. As such, in the event of a failure event, such as severing of a pilot line, movement of the control valve to its first or open position will not result in closing of the valve as no or insufficient charge will be present within the closing line.

When the valve control system is configured in the FAI mode of operation, the valve may be operated to move between open and closed positions by selective control of the control valve and charge within one or both of the opening and closing line.

The landing string may comprise a subsea test tree (SSTT). The SSTT may be located below the valve.

The landing string may comprise a latch configured to permit selective parting of the landing string. The latch may be positioned between the valve and the SSTT.

The landing string may comprise a shear sub. In use, the landing string may be located within a BOP such that the shear sub is aligned with a shear ram of the BOP.

The shear sub may be positioned between the valve and the SSTT.

One or more lines, such as control lines may extend along, through and/or past the shear sub. As such, in the event of the sear sub being cut by a BOP shear ram, so too will the lines. In some embodiments a pilot line associated with the control valve may extend along, through and/or past the shear sub. A closing line may extend along, through and/or past the shear sub.

The landing string may comprise one or more slick joints. In use, the landing string may be located within a BOP such that a slick join is aligned with a pipe ram of the BOP.

In use, the landing string may be deployable through a riser, such as a riser coupled between a surface vessel and wellhead infrastructure, such as a BOP.

BRIEF DESCRIPTION OF THE DRAWINGS

These and other aspects of the present invention will now be described, by way of example only, with reference to the accompanying drawings, in which.

DETAILED DESCRIPTION OF THE DRAWINGS

Figure 1:
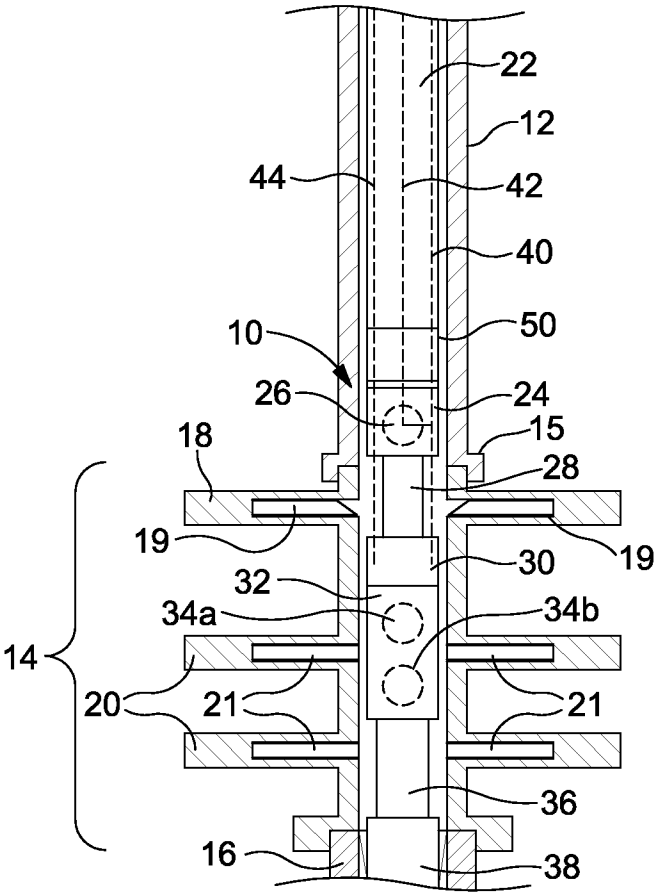
FIG. 1 is a diagrammatic illustration of a lower portion of a landing string in accordance with an embodiment of the present invention shown during final stages of deployment into a BOP.
Figure 4:
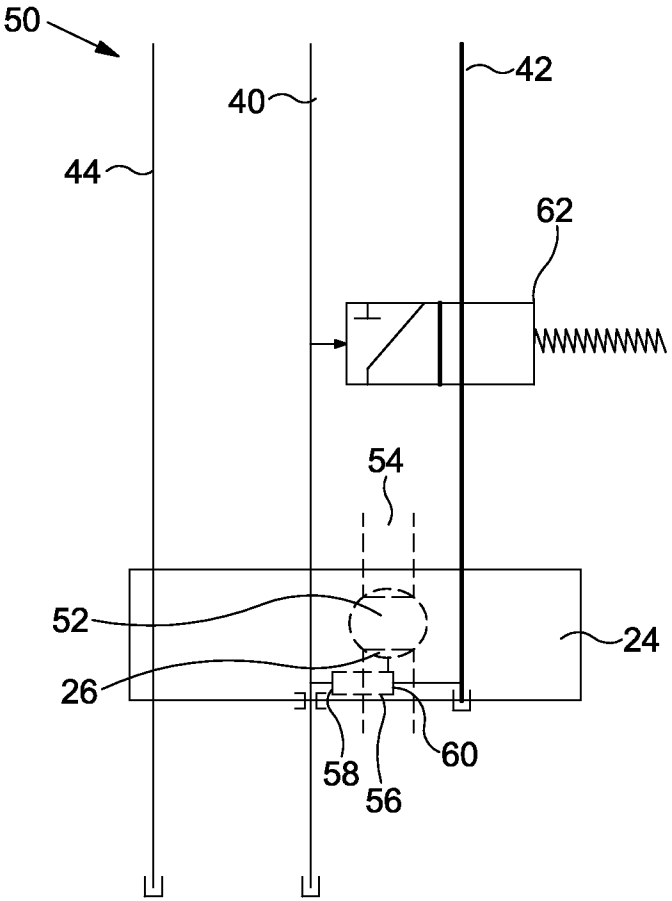
FIGS. 3 and 4 show a sequence of operating the valve control system of FIG. 2 to permit the valve to be closed, while still maintaining the valve in a FAI mode of operation.

FIG. 1 illustrates the lower portion of a landing string, generally identified by reference numeral 10, in accordance with an embodiment of the present invention, being deployed from a surface vessel (not shown) through a marine riser 12 into a BOP 14 which is mounted on a wellhead 16. The BOP 14 is of a standard configuration and includes a shear ram section 18 including shear rams 19 and a number of pipe ram sections 20 (two in the embodiment illustrated) each including pipe rams 21. As known in the art the shear ram section 18 and pipe ram sections 20 may be operated in accordance with a required well control. In the embodiment shown the marine riser 12 is secured to the BOP 14 via a flex joint connector 15 which provides a degree of permitted relative motion between the riser 12 and the BOP 14. This operates to effectively decouple motion of the surface vessel from the BOP 14.

Landing strings are known in the art and may include any number of required components and architecture.

In the present example embodiment the landing string 10 includes an upper tubing section 22 which extends from the surface vessel and terminates at a retainer valve 24. Although not shown, the upper tubing section 22 may include equipment such as a wireline lubricator valve and the like.

The retainer valve 24 is of a ball valve type, and includes a ball valve member 26, shown in broken outline, which is arranged to be rotated within the landing string 10 to selectively open and close a flow path extending therethrough. In the embodiment shown the retainer valve 24 has a cutting capability, allowing objects positioned within the landing string to be cut during closure of the ball valve member 26. The retainer valve 24 may define a shear and seal valve.

A shear sub 28 is located below the retainer valve 24, and when the landing string 10 is fully deployed the shear sub 28 is aligned with the shear ram section 18 of the BOP 14. The shear sub 28 facilitates cutting of the landing string 10 by actuation of the shear rams 19.

A latch 30 is positioned below the shear sub 28, and in use facilitates parting of the landing string 10 at this section, for example as may be required in certain situations, such as certain emergency situations.

A subsea test tree (SSTT) 32 is located below the latch 30, and in the embodiment shown includes a dual valve barrier, specifically including upper and lower ball valve members 34*a*, 34*b*. In use, the ball valve members 34*a*, 34*b* are operable to be rotated within the SSTT 32 to selectively open and close the flow path through the landing string 10, thus providing desired well control. The ball valve members 34*a*, 34*b* have a shearing capability, allowing objects positioned within the landing string to be cut during closure of said valve members 34*a*, 34*b*.

A slick joint section 36 is located below the SSTT 32 and in use provides a suitable engagement surface against which pipe rams 21 of the BOP may be sealingly closed.

A lowermost end of the landing string 10 includes a tubing hanger 38 which is landed within the wellhead 16.

A number of hydraulic control lines extend along the landing string 10, for example from surface, for use in controlling the various systems and components. In the example embodiment shown three control lines 40, 42, 44 are illustrated, in broken outline.

Control line 40 may communicate hydraulic power to the retainer valve 24 to operate the ball valve member 26 to open. Control line 40 may also function to provide hydraulic power to the latch 30 to retain the latch in a locked configuration.

Control line 42 may communicate hydraulic power to the retainer valve 24 to operate the ball valve member 26 to close. A valve control system 50, shown generally in broken outline, provides control to the retainer valve 24. As will be described in more detail below, the control system 50 assists in controlling the retainer valve 24 to operate under a desired safety protocol, such as a fail-as-is (FAI) mode of operation or a fail close (FC) mode of operation.

Control line 46 may provide hydraulic power to any other component or system within the landing string 10. In the exemplary embodiment shown the control line 46 provides a secondary control to the latch 30.

As illustrated, control lines 40 and 44 both extend past the shear sub 28, and as such in the event of activation of the shear ram section 18 will be cut, preventing hydraulic power to be maintained. In such a situation, the control system 50 may provide a degree of necessary control to allow the retainer valve 24 to operate under a desired safety protocol, such as a FC protocol.

In use, the landing string 10 may support a number of wellbore functions, including intervention operations. For example, the landing string 10 may provide a passage, via its flow path, for intervention tooling to be deployed into the wellbore from a surface vessel, for example on wireline or coiled tubing. Further, the landing string 10 may facilitate flow-back operations from the well to the surface vessel, for example as part of a well testing operation, clean-up operation or the like.

In the event of a well control scenario it may be necessary to entirely shut-in the well. In some instances this may be achieved by activating the SSTT 32 to close to contain well pressure, activating the retainer valve 24 to close to contain the fluids within the landing string 10, and then activating the latch 30 to part the landing string 10. The landing string 10 above the latch 30 may then be retrieved, leaving the SSTT 32 in place.

Following this the BOP 14 may be activated to close, for example via the shear ram section 18 and/or pipe ram sections 20.

In other situations, for example where an emergency event causes the BOP 14 to be actuated, the BOP shear rams 19 may close to cut through the shear sub 28 and control lines 40, 44. In such a situation the control system 50 may operate to ensure that the retainer valve 24 closes (fail close mode of operation) to maintain, as quickly as possible, the fluids within the landing string 22.

As described above, the landing string 10 includes a valve control system 50 for use in operating the retainer valve 24, and permitting selection of either a FAI mode of operation or a FC mode of operation. One embodiment of such a valve control system 50 will now be described with reference to FIGS. 2 to 8.

Figure 2:
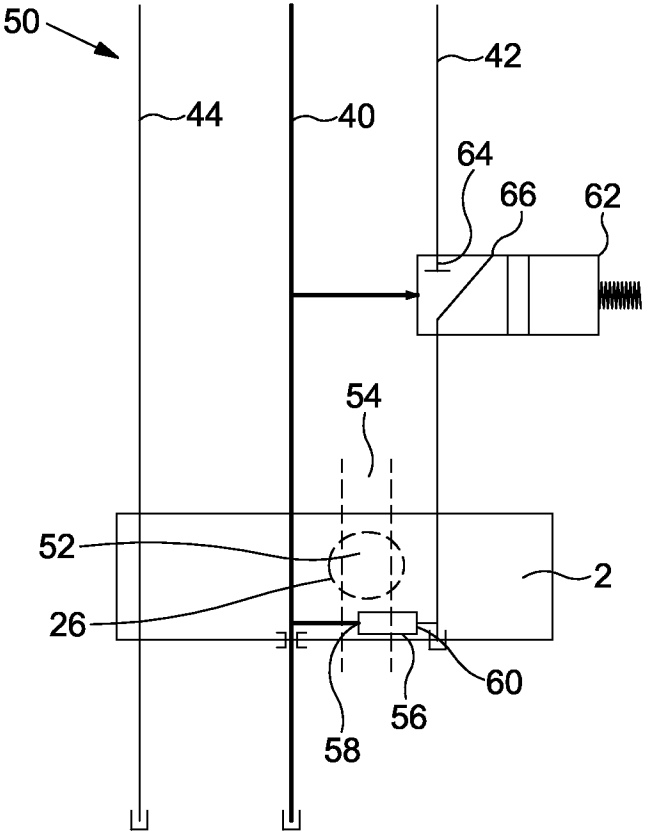
FIG. 2 is a diagrammatic illustration of a valve control system in accordance with an embodiment of the present invention for controlling a retainer valve of the landing string of FIG. 1, wherein the valve is located in an open position and the control system is configured such that the valve is controlled in a FAI mode of operation.

FIG. 2 provides a schematic illustration of the valve control system 50 and the retainer valve 24. As described above, the retainer valve 24 includes a ball valve member 26. The ball valve member 26 includes a bore 52 extending therethrough, wherein the valve member 26 is illustrated in FIG. 2 in a position in which the bore 52 is aligned with a flow path 54 of the landing string permitting flow and passage of objects therethrough. The retainer valve 24 also includes a valve actuator 56, for example in the form of a hydraulic piston which includes an opening port 58 and a closing port 60. In the configuration shown in FIG. 2, hydraulic pressure (represented by a thicker line) is provided via control line 40 to the opening port 58 of the valve actuator, thus positioning the valve member 26 in its open position. As such, control line 40 may be defined as an opening line.

The valve control system 50 includes a normally open control valve 62. As will be described in further detail below, the control valve 62 is operable to move between its normally open position and a closed position (as in FIG. 2) to selectively establish and prevent fluid communication between control line 42 and the closing port 60 of the valve actuator 56. As such, the control line 42 may be defined as a closing line.

The opening line 40 is in pressure communication with the control valve 62 to provide a pilot pressure for effectively operating the control valve 62 to move between its normally open position and its closed position. As such, the opening line 40 may also define a pilot line.

When the control valve 62 is in its closed configuration as shown in FIG. 2, the closing line 42 is isolated by a closed port 64 in the valve 62, while the closing port 60 of the valve actuator 56 is vented via a vent port 66 in the valve 62. Such venting of the closing port 60 prevents hydraulic lock within the valve 24 during opening by pressure applied via the opening line 40.

In the configuration shown in FIG. 2 the valve control system 50 is configured to control the valve 24 in a FAI mode of operation. This is achieved by removing or not applying pressure or significant pressure within the closing line 42. As such, in the event of a failure, such as loss of pressure in the opening/pilot line 40, resulting movement of the control valve 62 to its normally open position will not cause the retainer valve 24 to close, as zero or insufficient pressure will be applied at the closing port 60 of the actuator 56.

Figure 3:
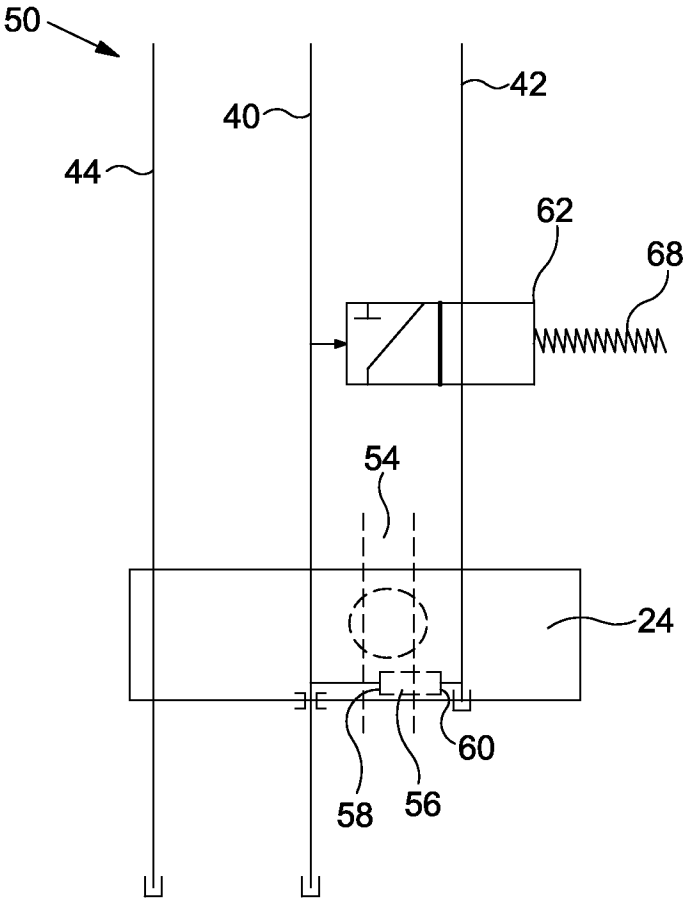

When it is desired to operate the valve 24 to close, the opening/pilot line 40 is first vented, as shown in FIG. 3, causing the control valve 62 to move (for example by a bias spring 68) to its normally open position. Following this, pressure is applied within the closing line 42 which is communicated, via the open control valve 62, to the closing port 60 of the valve actuator 56, causing the valve member 24 to close, misaligning the bore 52 from the flow path 54.

As noted above, in the arrangement of FIGS. 2 to 4 the retainer valve 24 is operated under a FAI mode of operation. In this respect the present invention permits an operator to select the particular mode of operation (FAI or FC). For example, certain operations may not necessarily require the retainer valve 24 to close in the event of a possible failure event. As an example, during deployment of the landing string 10 into the BOP 14, as illustrated in FIG. 1, the operator may decide that the safety margins associated with such an operation can permit a FAI mode of operation of the retainer valve 24 to be appropriate.

Figure 5:
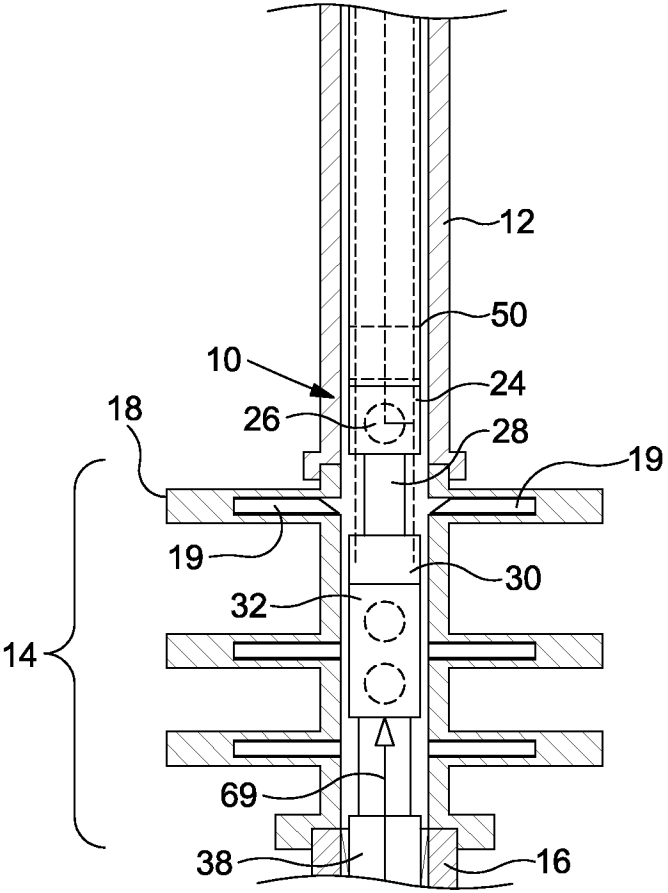
FIG. 5 is a diagrammatic illustration of the landing string of FIG. 1 shown during a flow-back operation in which well fluids are flowed upwardly through the landing string.

However, other operations may be such that a FC mode of operation of the retainer valve 24 is most appropriate. One example, as illustrated in FIG. 5, is during flow-back of well fluids to surface, illustrated by arrow 69. In such a circumstance it is desirable to be able to react quickly to close the retainer valve 24 to retain wellbore fluids within the landing string 10 in the event of a failure event, especially caused by closing of the shear rams 19 of the BOP 14. This is particularly true in gas wells where the well fluids within the landing string 10 comprise pressurised gas. As pressurised gas can contain very high levels of energy, a BOP shear event could potentially cause a high energy and rapid escape of the gas from the landing string, with the possible result of ejecting the landing string 10 upwardly through the vessel, with obvious risk to personnel and equipment. Accordingly, it is highly desirable to be able to operate the retainer valve 24 in a FC mode of operation to thus close as quickly as possible in response to such a failure event.

Figure 6:
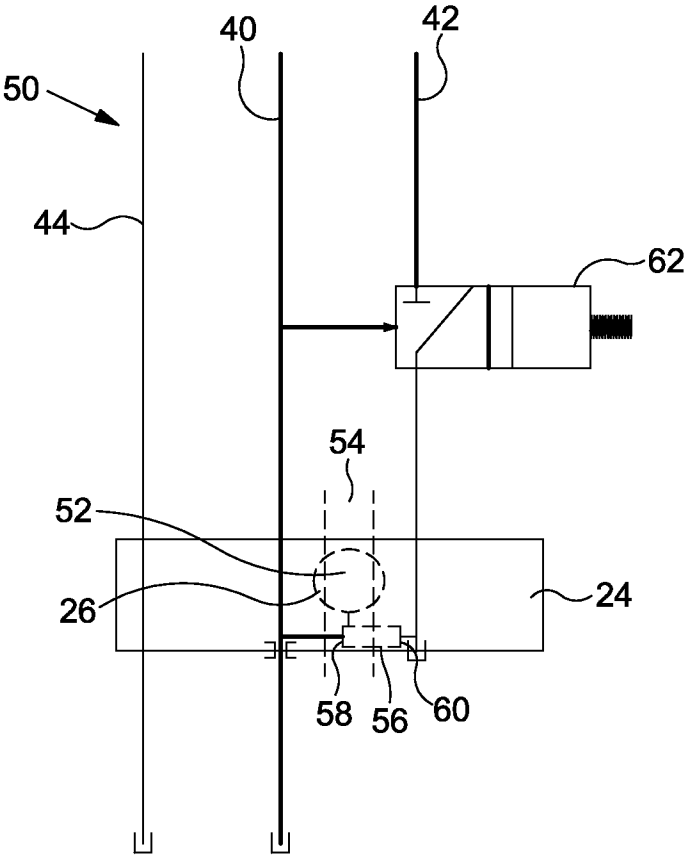
FIG. 6 shows the valve control system of FIG. 2, reconfigured into a FC mode of operation.

In the present example, the control system 50, as illustrated in FIG. 6, may be configured to permit the valve 24 to be operated as FC. Specifically, the opening/pilot line 40 is charged to firstly hold the valve member 26 in its open position, and secondly to hold the control valve 62 in its closed position. The closing line 42 is also charged, but isolated from the retainer valve 24 by the control valve 62. Accordingly, any failure event which might cause venting of the opening/pilot line 40 will cause the control valve 62 to move to its normally open position, communicating the charged closing line 42 to the retainer valve 24 to thus be closed.

Figure 8:
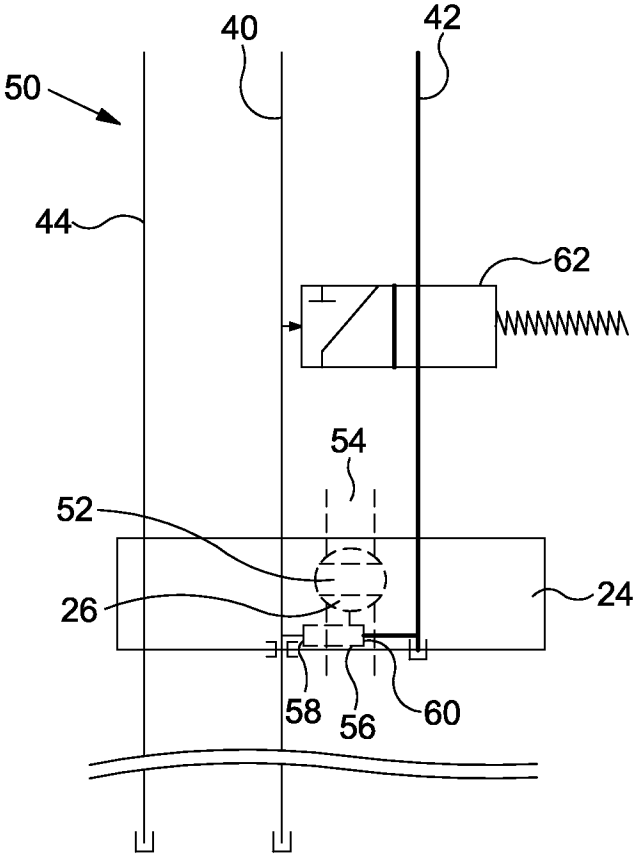
FIG. 8 illustrates the valve control system functioning to cause the valve to close following cutting of the landing string.
Figure 7:
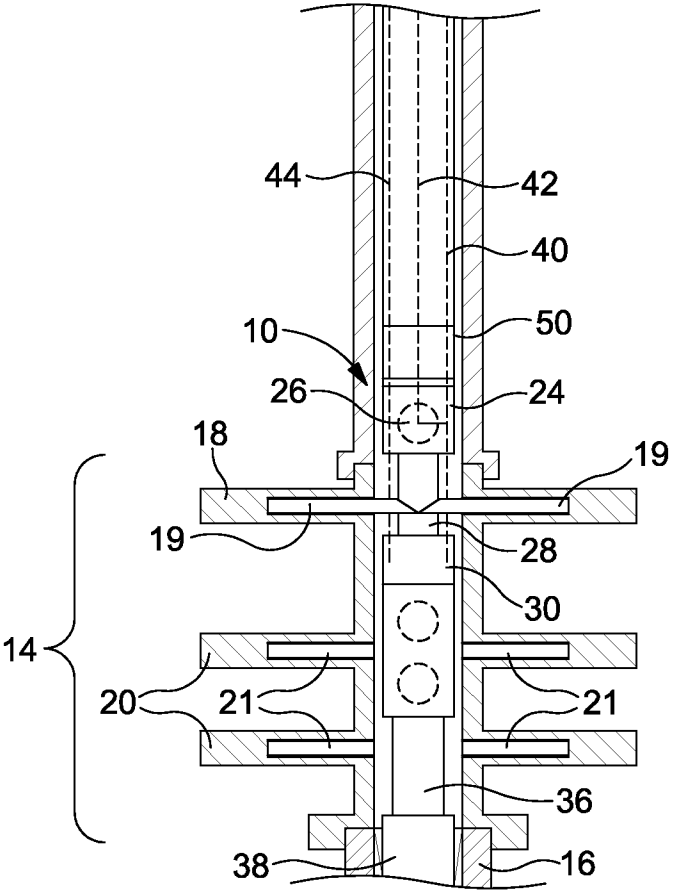
FIG. 7 shown the landing string of FIG. 1 being cut by a shear ram of the BOP which establishes a failure event.

A failure event within the landing string 10 is illustrated in FIG. 7, while the valve control system 50 is configured in the FC mode of operation, as illustrated in FIG. 6. In this respect the shear rams 19 of the BOP 14 have been caused to close, shearing the shear sub 28 and the control lines 40, 42. The pipe rams 21 of the BOP 14 are also indicated in a closed position. FIG. 8 provides an illustration of the reaction of the valve control system 50 to this failure event. In this respect shearing of the opening/pilot line 40 vents the pressure therein, allowing the control valve 62 to move to its normally open portion, communicating the charged closing line 42 with the valve 24, causing the ball valve member 26 to close and block the flow path 54.

Figure 9:
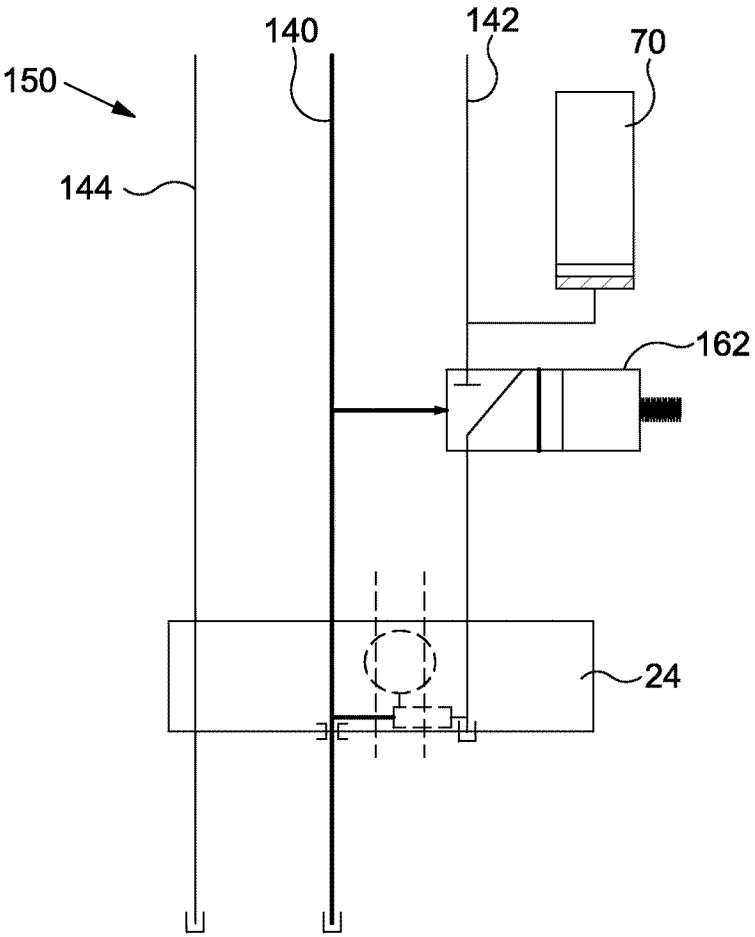
FIG. 9 is a diagrammatic illustration of a valve control system in accordance with an alternative embodiment of the present invention, wherein the valve under control is in an open position and the system is configured to operate the valve in a FAI mode of operation.

In the embodiment of the valve control system 50 first shown in FIG. 2 the closing line 42 may communicate with a source of hydraulic pressure, for example at surface level. In some alternative embodiments the valve control system may also include a pressure accumulator, as illustrated in FIG. 9. In this case the valve control system is identified by reference numeral 150, and is similar in most respects to the system 50 of FIG. 2, and as such like features share like reference numerals. As such, the system 150 includes, at least, an opening/pilot line 140, a closing line 142 and a normally open control valve 162. The system 150 further includes a pressure accumulator 70 which is in pressure communication with the closing line 142.

Figure 10:
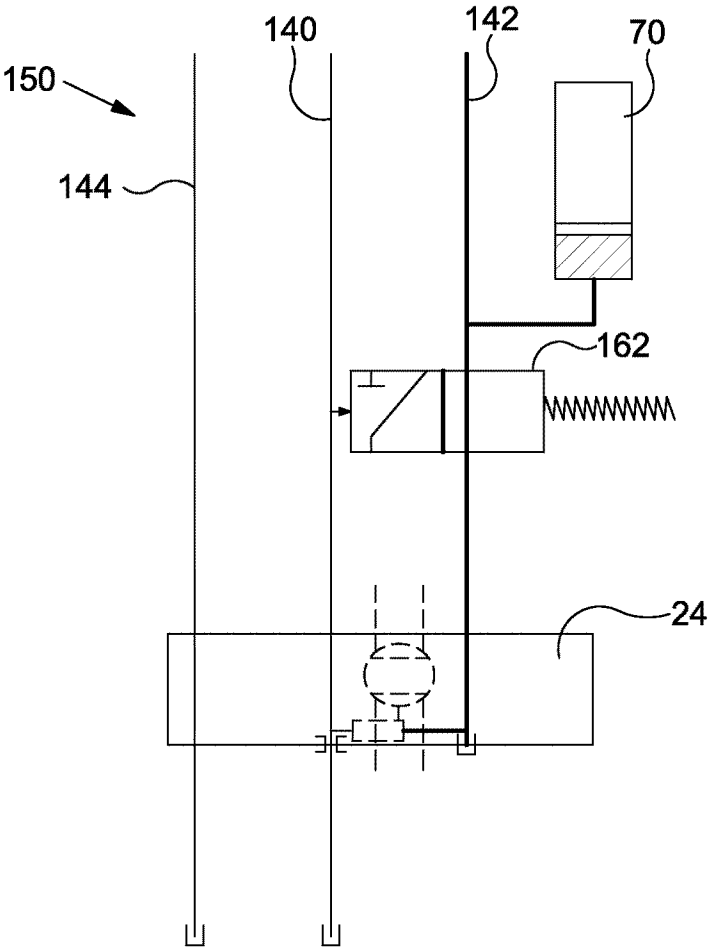
FIG. 10 illustrates the valve control system of FIG. 9 with the valve in a closed position, while maintaining the FAI mode of operation.

The system 150 is configured in FIG. 9 in a FAI mode of operation, with the retainer valve 24 open. Specifically, zero or reduced pressure is provided within the closing line 142 and the opening/pilot line 140 is charged to open and hold the retainer valve 24 in its open position, while closing the control valve 162. When the retainer valve 24 is to be closed the pressure within the opening/pilot line 140 is vented, allowing the control valve 162 to move towards its normally open position, following which pressure may be applied in the closing line 142, as shown in FIG. 10, to cause the retainer valve 24 to close.

Figure 11:
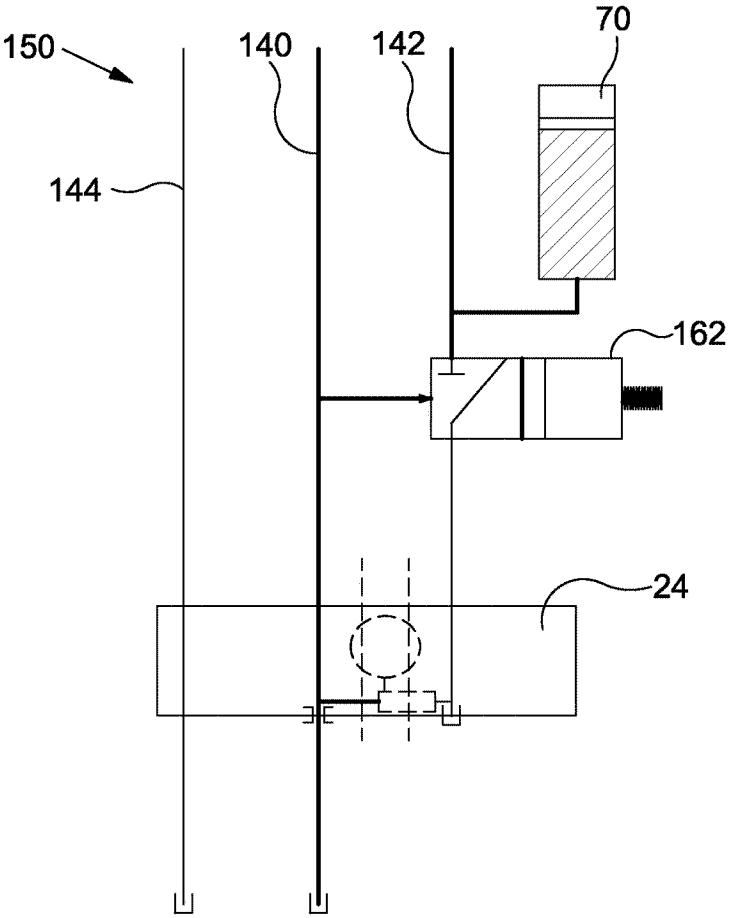
FIG. 11 illustrates the valve control system of FIG. 9 reconfigured to operate the valve in a FC mode of operation.

The system 150 is shown in FIG. 11 reconfigured to operate the retainer valve 24 in a FC mode of operation. This is achieved by providing pressure within the opening/pilot line 140 to open the retainer valve 24 and hold the control valve 162 in its closed position, while also providing pressure within the closing line 142. In this respect the closing line pressure is isolated from the retainer valve 24 by the closed control valve 162. While in this configuration pressure within the closing line 142 may charge the pressure accumulator 70.

Figure 12:
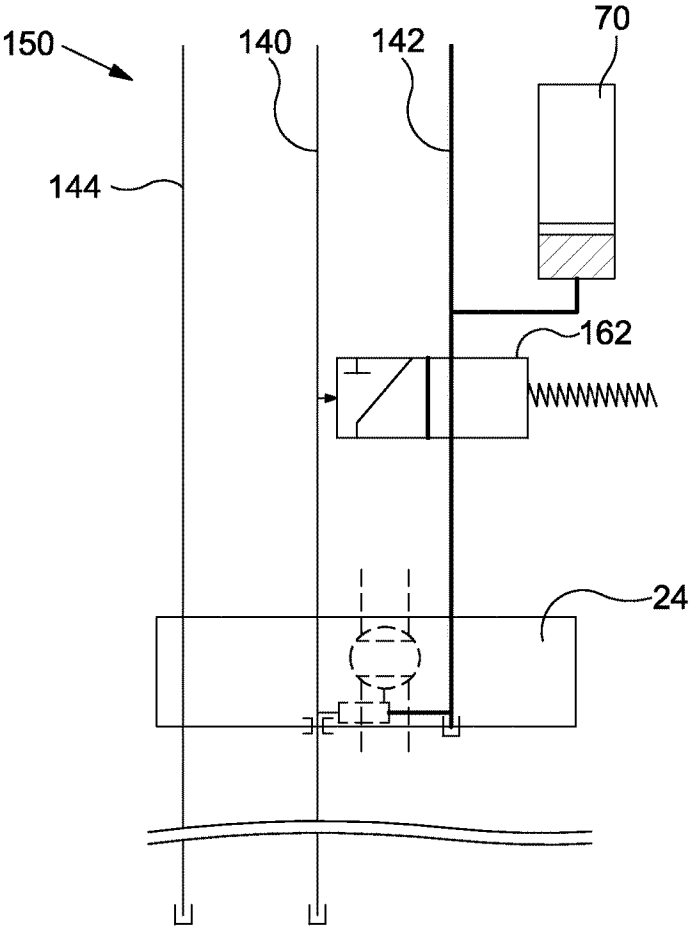
FIG. 12 illustrates the valve control system of FIG. 9 with the valve closed following a failure event.

In the event of a failure event, such as actuation of the BOP shear rams 19 (see FIG. 7), the opening/pilot line 140 is severed causing pressure to vent and allowing the control valve 162 to move to its normally open position, immediately communicating pressure to the retainer valve 24 to cause this to close, as illustrated in FIG. 12. The pressure accumulator 70 can assist to provide or improve the response time of actuation pressure to close the retainer valve 24, which may have advantages when used in combination with flowing gas wells, for example. Further, the pressure accumulator 70 may provide a degree of safety in that once charged the retainer valve 24 can still be closed even in the event of some failure in the original pressure source.

In some embodiments including a pressure accumulator, a venting arrangement may be provided which permits accumulated pressure to be vented during retrieval of the control system back to surface. This may accommodate changes in hydrostatic pressure during retrieval, and avoid a dangerous pressure differential associated with the pressure accumulator from being established.

Figure 13:
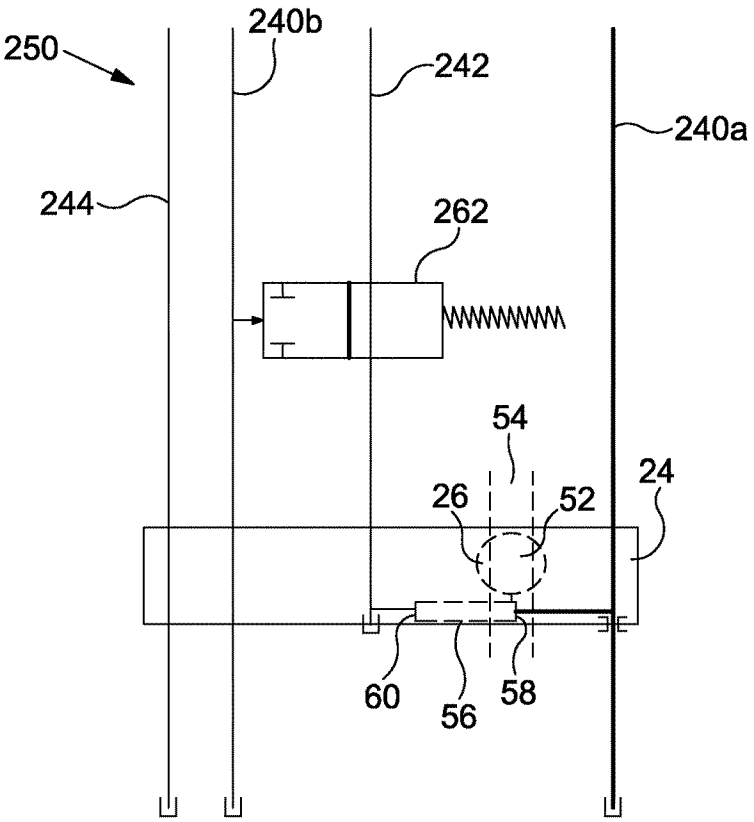
FIG. 13 is a diagrammatic illustration of a valve control system in accordance with a further alternative embodiment of the present invention, wherein the valve under control is in an open position and the system is configured to operate the valve in a FAI mode of operation.

In the embodiments described above a single control line 40, 140 is provided to function as both an opening line for the retainer valve 24 and a pilot line for the control valve 62, 162. However, in other embodiments separate individual lines may be utilised, as illustrated in FIG. 13, which provides a diagrammatic illustration of a control system 250 in accordance with an alternative embodiment of the present invention. The control system 250 is largely similar to system 50 first shown in FIG. 2 and as such like features share like reference numerals, incremented by 200.

The system 250 is capable of operating the retainer valve 24 of the landing string 10, and includes an opening line 240*a* which is in communication with the opening port 58 of the valve actuator 56, such that when pressure is applied within the opening line 240*a*, as illustrated by a thick line in FIG. 13, the valve member 267 is opened to align the bore 52 with the flow path 54.

The system 250 further includes a normally open control valve 262 and a separate pilot line 240*b*, which may be in the form of a pigtail, which extends to communicate control pressure to the control valve 262 to selectively control this to move between open and closed positions, as described in more detail below. The pilot line 240*b* extends past the shear sub 28 of the landing string 10 (see FIG. 1), and as such is aligned with the shear rams 19 of the BOP 14 and thus will be cut and vented in the event of a BOP actuation.

In the arrangement shown in FIG. 13, the retainer valve 24 is open and the system is configured in a FAI mode of operation. In this respect pressure is applied within the opening line 240*a* to open the retainer valve 24. The pilot line 240*b* is vented, such that the control valve 262 is configured in its normally open position, thus establishing communication of the closing line 242 with the retainer valve 24, specifically with the closing port 60 of the valve actuator 56. The closing port 60 of the valve actuator 56 may thus be vented directly through the closing line 242, rather than through a separate vent port in the control valve 262.

Figure 14:
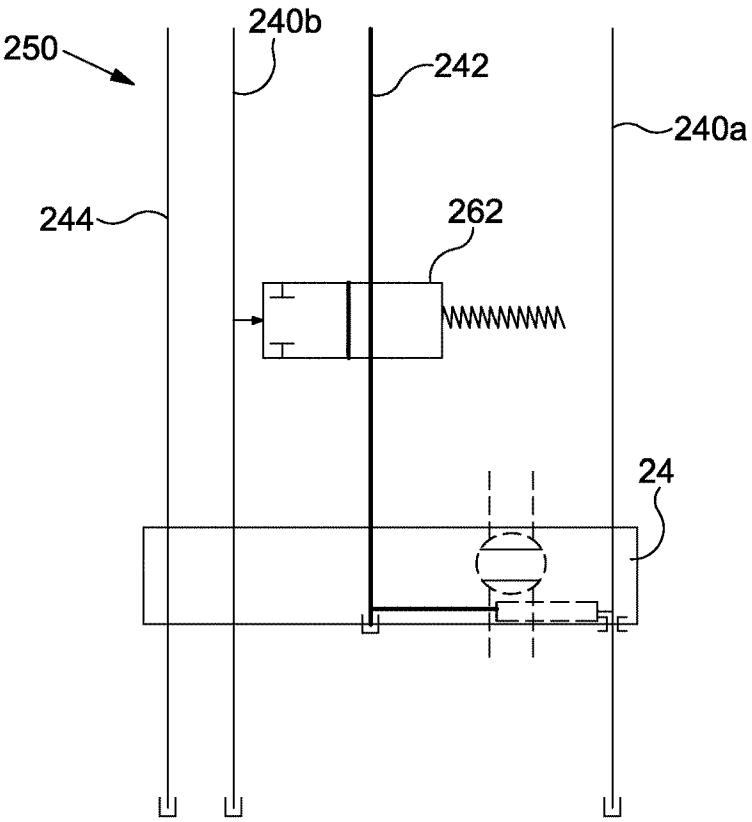
FIG. 14 illustrates the valve control system of FIG. 13 with the valve in a closed position, while maintaining the FAI mode of operation.

When it is necessary to operate the retainer valve 24 to close, for example to perform a pressure test, the opening line 240*a* may be vented and the closing line 242 pressurised, as illustrated in FIG. 14, thus permitting the valve 24 to close. This procedure is reversed to re-open the valve 24. It should be noted that the retainer valve 24 may be operated to open and close under this FAI mode of operation without requiring activation of the control valve 262. Accordingly, the normal operation of the valve 24 may be simplified by the presence of separate opening and pilot lines 240*a*, 240*b*.

Figure 15:
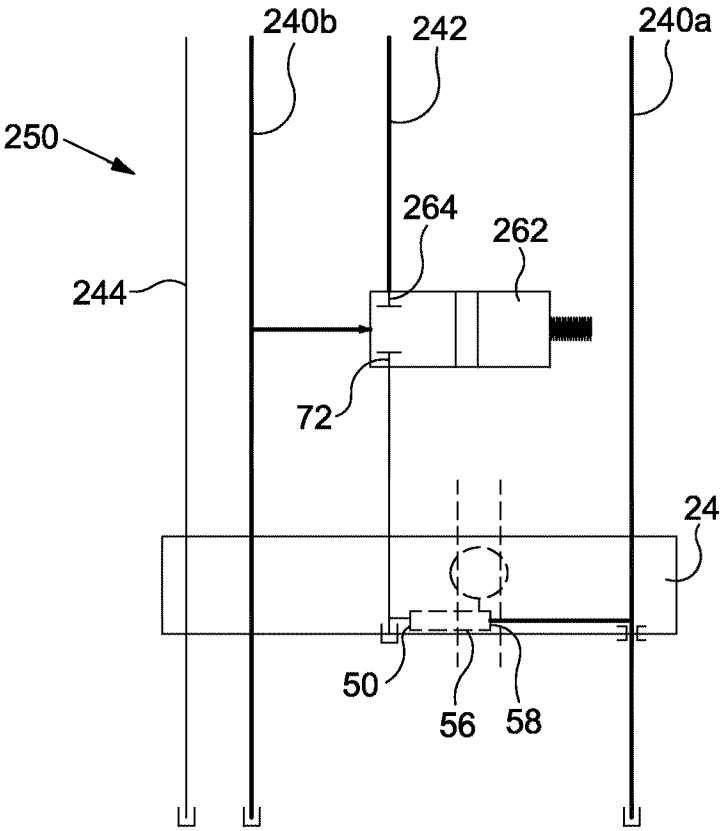
FIG. 15 illustrates the valve control system of FIG. 13 reconfigured to operate the valve in a FC mode of operation.

FIG. 15 illustrates the control system 250 configured to provide a FC mode of operation. This is achieved by pressurising the opening line 240*a* to open the valve 24, pressuring the pilot line 240*b* to cause the control valve 262 to close, and pressurising the closing line 242, wherein the closing line pressure is prevented from communicating with the retainer valve 24 by a closed port 264 of the control valve 262. Furthermore, it should be noted that the closing port 60 of the valve actuator 56 is sealed by a closed port 72 provided in the control valve 262, thus preventing risk of drawing any fluids, for example, into the actuator 56.

Figure 16:
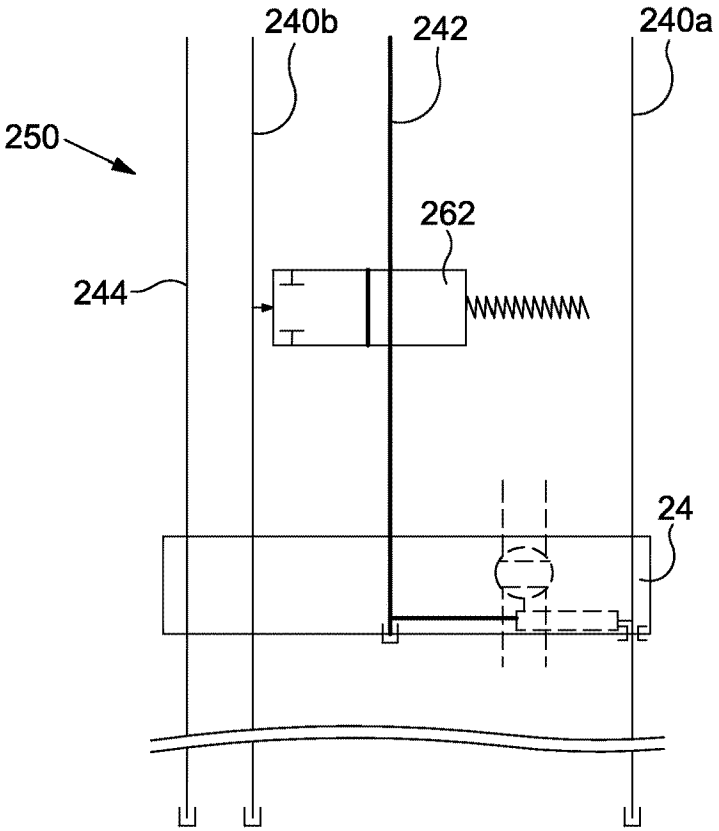
FIG. 16 illustrates the valve control system of FIG. 13 with the valve closed following a failure event.

In the event of a failure event, such as actuation of the BOP shear rams 19 (see FIG. 7), the pilot line 240*b* is severed causing pressure to vent and allowing the control valve 262 to move to its normally open position, immediately communicating pressure from the closing line 242 to the retainer valve 24 to cause this to close, as illustrated in FIG. 16. Further, during activation of the BOP the opening line 240*a* will also be severed, causing this to be vented and thus preventing hydraulic locking within the valve 24 during closing.

Figure 17:
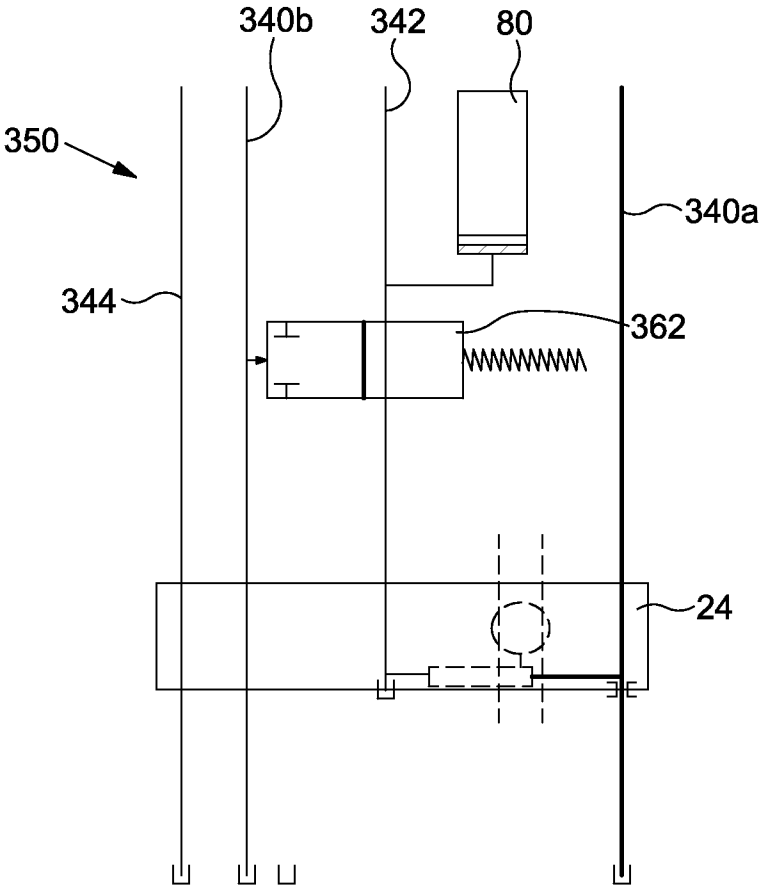
FIG. 17 is a diagrammatic illustration of a valve control system in accordance with a further alternative embodiment of the present invention, wherein the valve under control is in an open position and the system is configured to operate the valve in a FAI mode of operation.

The control system 250 may be modified to also include a pressure accumulator, in a similar manner to the system 150 of FIG. 9. Such a modified system, in this case generally identified by reference numeral 350, is illustrated in FIG. 17. The system 350 is largely similar to the system 250 first shown in FIG. 13, and as such like features share like reference numerals, incremented by 100. As such, the system 350 includes, at least, an opening line 340*a*, a pilot line 340*b*, a closing line 342 and a normally open control valve 362. The system 350 further includes a pressure accumulator 80 which is in pressure communication with the closing line 342.

Figure 18:
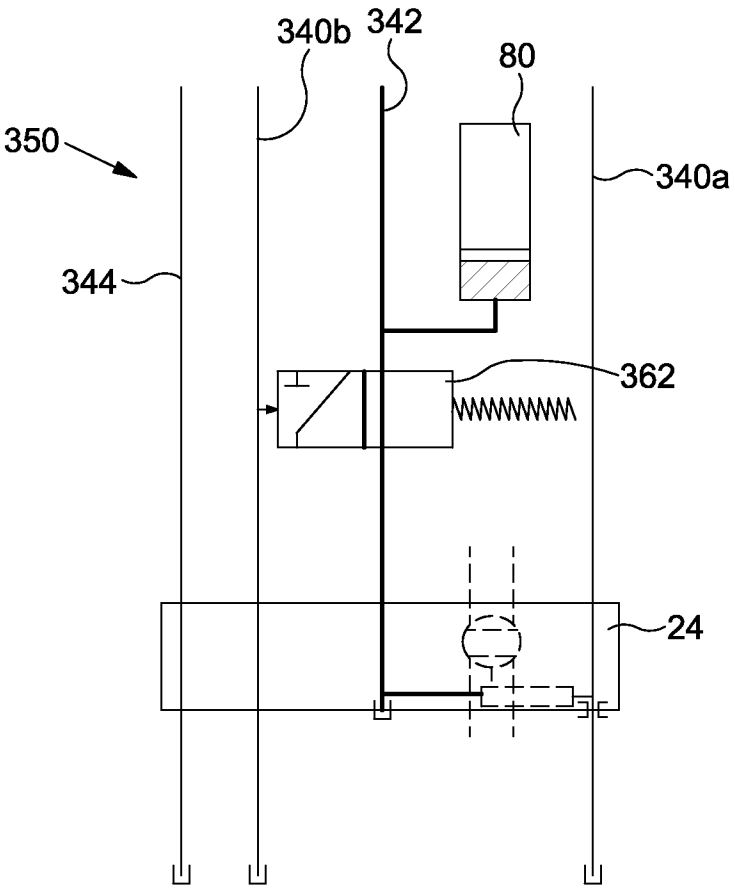
FIG. 18 illustrates the valve control system of FIG. 17 with the valve in a closed position, while maintaining the FAI mode of operation.

The system 350 is configured in FIG. 17 in a FAI mode of operation, with the retainer valve 24 open. Specifically, zero or reduced pressure is provided within the closing and pilot lines 342, 340*b*, and the opening line 340*a* is charged to open and hold the retainer valve 24 in its open position. When the retainer valve 24 is to be closed the pressure within the opening line 340*a* is vented and pressure is applied in the closing line 342, as shown in FIG. 18, to cause the retainer valve 24 to close.

Figure 19:
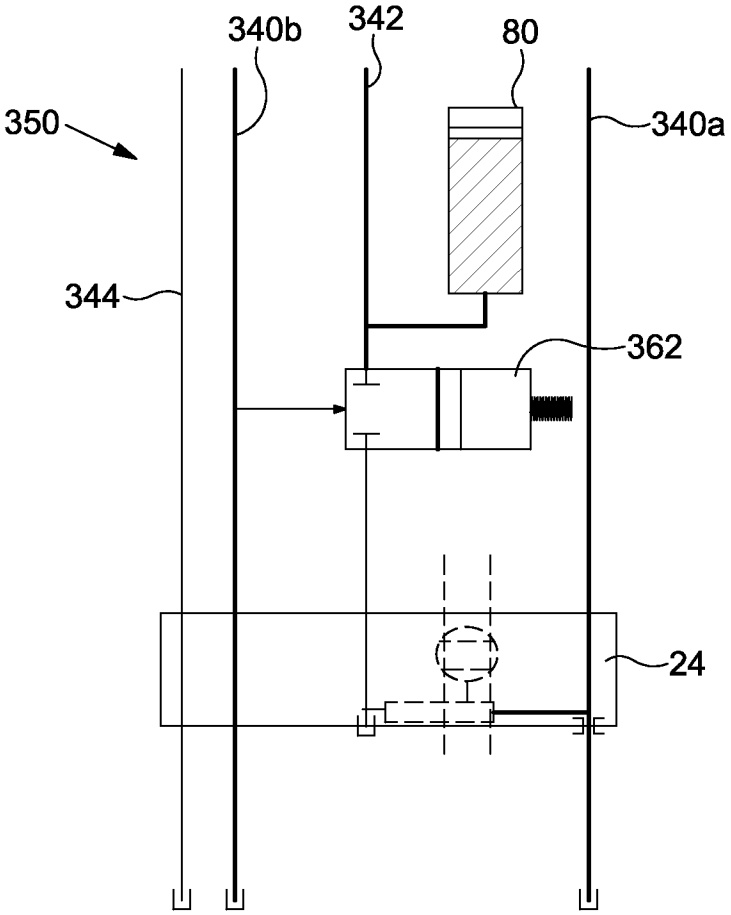
FIG. 19 illustrates the valve control system of FIG. 17 reconfigured to operate the valve in a FC mode of operation.

The system 350 is shown in FIG. 19 reconfigured to operate the retainer valve 24 in a FC mode of operation. This is achieved by providing pressure within the opening line 340*a* to open the retainer valve 24, providing pressure within the closing line 342 while also providing pressure within the pilot line 340*b* which closes the control valve 362. In this respect the closing line pressure is isolated from the retainer valve 24 by the closed control valve 362. While in this configuration pressure within the closing line 342 may charge the pressure accumulator 80.

Figure 20:
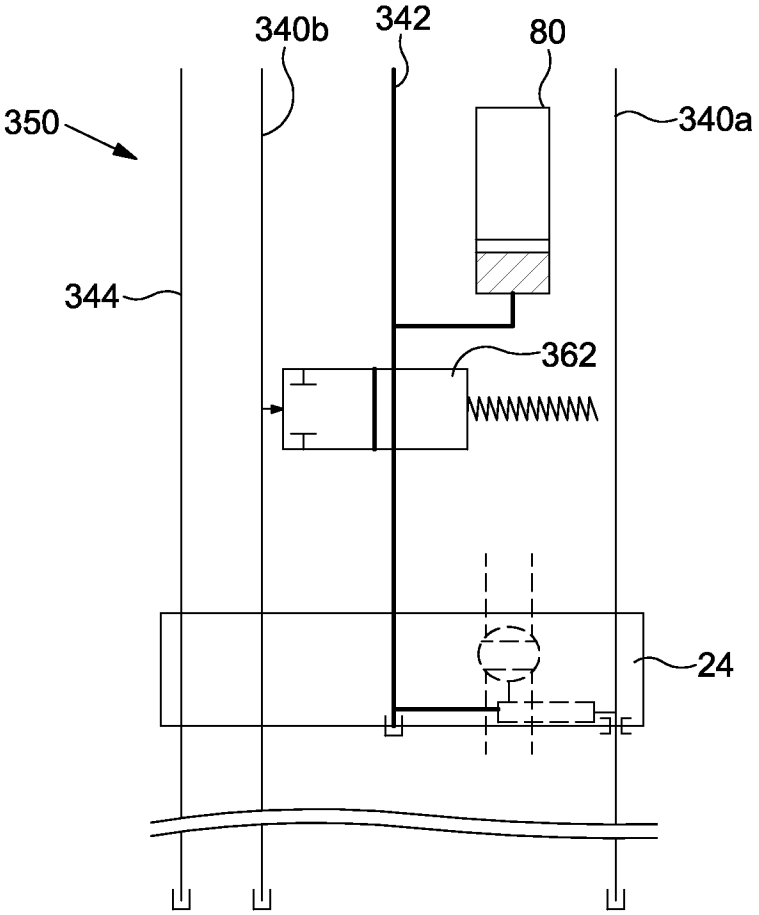
FIG. 20 illustrates the valve control system of FIG. 13 with the valve closed following a failure event.

In the event of a failure event, such as actuation of the BOP shear rams 19 (see FIG. 7), the pilot line 340*b* is severed causing pressure to vent and allowing the control valve 362 to move to its normally open position, immediately communicating pressure to the retainer valve 24 to cause this to close, as illustrated in FIG. 20. The pressure accumulator 80 can assist to provide or improve the response time of actuation pressure to close the retainer valve 24, which may have advantages when used in combination with flowing gas wells, for example.

It should be understood that the embodiments described herein are merely exemplary and that various modifications may be made thereto without departing form the scope of the invention. For example, is some instances the valve under control may be any other valve within the landing string, such as a lubricator valve, SSTT valve or the like.

What is claimed is:

1. A landing string, comprising:

a valve having a valve member mounted within a flow path extending through the landing string; and a valve control system for use in operating the valve to move the valve member between open and closed positions to control flow along the flow path, wherein the valve control system comprises a closing line for providing communication of pressure to the valve to facilitate closing of the valve member, and a control valve operable between a first control valve configuration in which the closing line is in communication with the valve and a second control valve configuration in which the closing line is isolated from the valve; and a pilot line for communicating a pilot pressure which operates the control valve to move from its first control valve configuration to its second control valve configuration, and wherein relief of said pilot pressure from the pilot line permits the control valve to move from its second control valve configuration to its first control valve configuration;

wherein the valve control system is selectively reconfigurable prior to a failure event comprising relief of pilot pressure within the pilot line between:

a first configuration in which the valve is operated or controlled under a fail-as-is (FAI) mode of operation; and a second configuration in which the valve is operated or controlled under a fail-close (FC) mode of operation.

2. The landing string according to claim 1, wherein the valve control system is reconfigurable prior to a failure event in accordance with an operator preference.

3. The landing string according to claim 1, wherein the valve control system is reconfigurable between the FAI and FC modes of operation in accordance with operation of a blow out preventer (BOP).

4. The landing string according to claim 1, wherein the valve is a retainer valve.

5. The landing string according to claim 1, wherein the valve is operable to cut an object located within the flow path of the landing string during movement of the valve member from its open position to its closed position.

6. The landing string according to claim 1, wherein the valve comprises:

an opening port for facilitating communication with a source of pressure to operate the valve member to move towards an open position; and a closing port for facilitating communication with a source of pressure to operate the valve member to move towards a closed position.

7. The landing string according to claim 1, wherein the valve control system comprises:

an opening line for providing communication of pressure to the valve to facilitate opening of the valve member.

8. The landing string according to claim 7, wherein the opening line is operable to communicate pressure to other components or systems of the landing string.

9. The landing string according to claim 7, wherein the pilot line is defined by the valve opening line.

10. The landing string according to claim 1, further comprising a pressure accumulator associated with the closing line.

11. The landing string according to claim 1, wherein when the control valve is in its first control valve configuration, pressure applied within the closing line facilitates operation of the valve member to move to and/or be held within its closed position.

12. The landing string according to claim 1, wherein when the control valve is in its first control valve configuration venting is permitted from the valve via the closing line.

13. The landing string according to claim 1, wherein when the control valve is in its second control valve configuration, venting is permitted from a portion of the valve.

14. The landing string according to claim 1, wherein the control valve is biased towards its first control valve configuration.

15. The landing string according to claim 1, wherein the control valve is a normally open valve.

16. The landing string according to claim 1, wherein the pilot line provides a dedicated function of operating the control valve.

17. The landing string according to claim 1, wherein the failure event comprises severing of the pilot line.

18. The landing string according to claim 1, further comprising a shear sub located below the valve, wherein, in use, the landing string is locatable within a blow out preventer (BOP) such that the shear sub is aligned with a shear ram of the BOP, the pilot line extending along the shear sub such that the pilot line extends from a source of power and along the shear sub via the control valve.

19. A method for controlling a valve within a landing string which includes a flow path, a valve member mounted within the flow path, and a valve control system for use in operating the valve to move the valve member between open and closed positions to control flow along the flow path, wherein the valve control system comprises a closing line for providing communication of pressure to the valve to facilitate closing of the valve member, and a control valve operable between a first control valve configuration and a second control valve configuration, the method comprising:

providing a pilot charge in a pilot line to operate the control valve to move from a first control valve configuration in which the closing line is in communication with the valve to a second control valve configuration in which the closing line is isolated from the valve, wherein relief of the pilot pressure permits the control valve to move from its second control valve configuration to its first control valve configuration; and reconfiguring the valve control system prior to a failure event comprising relief of pilot pressure within the pilot line between:

a first configuration in which the valve is operated or controlled under a fail-as-is (FAI) mode of operation; and a second configuration in which the valve is operated or controlled under a fail-close (FC) mode of operation.

20. The method according to claim 19, comprising configuring the valve control system prior to the failure event:

in the first configuration by not pressurizing or preventing the closing line from being pressurized while the control valve is in its second control valve configuration; and in the second configuration by pressurizing the closing line while the control valve is in its second control valve configuration.

21. A landing string, comprising:

a valve having a valve member mounted within a flow path extending through the landing string; and a valve control system for use in operating the valve to move the valve member between open and closed positions to control flow along the flow path, wherein the valve control system comprises a closing line for providing communication of power to the valve to facilitate closing of the valve member, and a control valve operable between a first control valve configuration in which the closing line is in communication with the valve and a second control valve configuration in which the closing line is isolated from the valve, wherein the valve control system is selectively reconfigurable prior to a failure event between:

a first configuration in which the valve is operated or controlled under a fail-as-is (FAI) mode of operation by not charging or preventing the closing line from being charged while the control valve is in its second control valve configuration; and a second configuration in which the valve is operated or controlled under a fail-close (FC) mode of operation by charging the closing line while the control valve is in its second control valve configuration.

* * * * *